US005691608A

United States Patent [19]

Yamamoto et al.

[11] Patent Number: 5,691,608

[45] Date of Patent: Nov. 25, 1997

[54] IMAGE DISPLAY APPARATUS

[75] Inventors: Mitsuru Yamamoto; Hidetoshi Suzuki, both of Atsugi; Ichiro Nomura; Toshiaki Majima, both of Tokyo, all of Japan

[73] Assignee: Canon Kabushiki Kaisha, Tokyo, Japan

[21] Appl. No.: 92,948

[22] Filed: Jul. 19, 1993

Related U.S. Application Data

[63] Continuation of Ser. No. 825,331, Jan. 27, 1992, abandoned, which is a continuation of Ser. No. 586,382, Aug. 14, 1990, abandoned, which is a continuation of Ser. No. 58,114, Jun. 4, 1987, abandoned.

[30] Foreign Application Priority Data

| | | | |
|---|---|---|---|
| Jun. 16, 1986 | [JP] | Japan | 61-138227 |
| Jun. 16, 1986 | [JP] | Japan | 61-138228 |
| Jun. 16, 1986 | [JP] | Japan | 61-138229 |
| Jun. 16, 1986 | [JP] | Japan | 61-138230 |

[51] Int. Cl.[6] ..... G09G 1/04; H01J 29/56

[52] U.S. Cl. ..... 315/383; 315/13.1; 313/409

[58] Field of Search ..... 315/13.1, 383, 315/167, 169.4; 313/409, 411, 461, 467, 469, 498, 500, 441; 348/809

[56] References Cited

U.S. PATENT DOCUMENTS

| | | | |
|---|---|---|---|
| 3,449,620 | 6/1969 | Caron et al. | 315/383 |
| 3,579,015 | 5/1971 | Gregory | 358/240 |
| 3,720,859 | 3/1973 | Hilden | 315/383 |
| 3,845,243 | 10/1974 | Schmersal et al. | 358/240 |
| 3,863,023 | 1/1975 | Schmersal et al. | 315/169.1 |
| 4,067,047 | 1/1978 | Ryan | 358/240 |
| 4,259,678 | 3/1981 | Van Gorkom et al. | 357/13 |
| 4,303,930 | 12/1981 | Van Gorkom et al. | 357/13 |
| 4,325,084 | 4/1982 | van Gorkum et al. | 358/242 |
| 4,361,781 | 11/1982 | Depp et al. | 313/409 |
| 4,368,467 | 1/1983 | Unotoro et al. | 340/799 |
| 4,701,811 | 10/1987 | Moriguchi et al. | 358/283 |

FOREIGN PATENT DOCUMENTS

| | | | |
|---|---|---|---|
| 38528 | 1/1982 | Japan . | |
| 0004249 | 1/1983 | Japan | 313/368 |

*Primary Examiner*—Gregory C. Issing
*Attorney, Agent, or Firm*—Fitzpatrick, Cella, Harper & Scinto

[57] ABSTRACT

An image display apparatus in which luminance contrast is produced by the act of scanning of electron beams is disclosed. The apparatus of this invention includes: a screen including a plurality of picture elements each having a plurality of miniature luminescent units which respectively exhibit luminescence in response to the application of a plurality of electron beams, the picture elements being arranged in lines and columns; electron-beam generating means for generating the plurality of electron beams which respectively define the plurality of miniature luminescent units in each of the picture elements; control means for controlling emission of the plurality of electron beams so that the number of the miniature luminescent units which exhibit luminance in each of the picture elements may be controlled in accordance with a video signal; and/or means for controlling emission the period of time available for the emission of at least one of the plurality of electron beams.

39 Claims, 11 Drawing Sheets

IMAGE DISPLAY APPARATUS

This application is a continuation of application Ser. No. 07/825,331, filed Jan. 27, 1992, which is a continuation of application Ser. No. 07/586,382, filed Aug. 14, 1990, which is a continuation of application Ser. No. 07/058,114, filed Jun. 4, 1987, now all abandoned.

BACKGROUND OF THE INVENTION

1. Field of the Invention

The present invention relates to an image display apparatus, and more particularly to an image display apparatus of the type which incorporates a solid-state electron beam generating device.

2. Description of the Prior Art

A solid-state electron beam generating device of the type which is employed in the present invention is disclosed, for example, in Japanese Patent Publication No. 30274/1979, Japanese Patent Laid-open No. 111272/1979 (U.S. Pat. No. 4,259,678), Japanese Patent Laid-open No. 15529/1981 (U.S. Pat. No. 4,303,930) and Japanese Patent Laid-open No. 38528/1982. The present invention contemplates a novel proposal with respect to an image display apparatus in which various problems encountered by the prior art are ameliorated.

In general, since a typical solid-state electron beam generating device possesses such advantages as high-density electron emission and potentiality with respect to high-density integration, various proposals have heretofore been made in connection with the application of such a device to image display apparatus. In order to reproduce the halftone of an image to be displayed, the prior-art proposals give consideration to a method of controlling the quantity of electrons emitted from a solid-state electron beam generating device.

In general, the prior-art method in which electron emission is controlled in an analog manner involves a significant problem in that, since variations in the density of electrons emitted from each element of an integrated electron beam generating device seriously affect the quality of a displayed image, a high degree of uniformity must be realized as between the respective elements.

FIGS. 17A, 17B and 17C are graphs showing several relationships between beam current density, fluorescent intensity and the voltage applied to a fluorescent screen (ZnSiO;Mn) used in a typical image display apparatus of this kind. FIG. 17A is a graph showing the relationship between the beam current density and the fluorescent intensity, and representing a characteristic in which the fluorescent intensity varies in proportion to the current density within a lower range thereof but is saturated when the current density further increases. FIG. 17B is a graph showing the characteristic of the relationship between the voltage applied to the solid-state electron beam generating device and the density of emission current. Since a typical electron beam generating device of this kind employs p-n junctions of a semiconductor, no electron is emitted until the level of the applied voltage reaches a threshold voltage $V_0$, but, when the threshold voltage $V_0$ is exceeded, the emission current increases with the characteristics of an exponential function. When the level of the applied voltage is further increased, the saturation of the emission current density takes place under the influence of a space-charge effect in the vicinity of a surface from which electrons are emitted or lead electrodes. Since both phosphers and the solid-state electron beam generating device exhibit the aforesaid characteristics, the relationship shown in FIG. 17C is established between the applied voltage and the fluorescent intensity. As shown in FIG. 17C, when the level of the applied voltage is lower than that of the threshold voltage, the fluorescent intensity is substantially zero. However, when the applied voltage exceeds the threshold voltage, the fluorescent intensity abruptly increases and immediately reaches a saturation level. When a halftone is to be reproduced by means of the applied voltage in a solid-state electron beam generating device having such characteristics, it is necessary to use a steep portion of the applied voltage-fluorescent intensity characteristics (defined between A and B in FIG. 17C). Thus, even if the level of the applied voltage varies only by an extremely small amount, the fluorescent intensity varies greatly, and this makes it difficult to realize the proper reproduction of a halftone.

In a case where this type of solid-state electron beam generating device is arranged in an integrated manner such that a multiplicity of electron sources are integrated on a single substrate so as to allow for multi-beam emission, the applied voltage-fluorescent intensity characteristics of the respective electron sources are varied as indicated, for example, by a broken line A'–B' and a one-dot chain line A"–B" in FIG. 17C. Therefore, this integration disables all the integrated electron sources from being driven under the same conditions, and this makes it even more difficult to reproduce a halftone due to variations in the applied voltage.

It may be readily anticipated that, if a multiplicity of such solid-state electron beam generating devices are manufactured at the same time, the individual solid-state electron beam sources will exhibit random variations in their respective characteristics. Accordingly, if a multiplicity of image display apparatus of the type which reproduces a halftone by means of variations in the applied voltage are manufactured by incorporating therein such solid-state electron beam generating devices, it is necessary to adjust both the applied voltage and the fluorescent intensity for each individual image display apparatus, and this may impose material difficulties upon the running of a production line.

In addition, performance of the analog control may require a large number of analog elements for incorporation into the peripheral circuits of the solid-state electron beam generating device, and this could result in various disadvantages such as complication of the circuits of the apparatus and an increase in the production cost.

SUMMARY OF THE INVENTION

It is therefore an object of the present invention to provide an image display apparatus which is capable of simply reproducing a halftone without the need for a high degree of uniformity between the characteristics of the respective electron sources in a solid-state electron beam generating device.

In order to achieve the object, the present invention provides an image display apparatus in which luminance contrast is produced by the act of scanning of electron beams, comprising: a screen including a plurality of picture elements each having a plurality of miniature luminescent units which respectively exhibit luminescence in response to the application of a plurality of electron beams, the picture elements being arranged in lines and columns; electron-beam generating means for generating the plurality of electron beams which respectively define the plurality of miniature luminescent units in each of the picture elements; control means for controlling emission of the plurality of electron beams so that the number of the miniature luminescent units which exhibit luminance in each of the picture elements may be controlled in accordance with a video signal; and/or means for controlling the period of time available for the emission of at least one of the plurality of electron beams.

Further objects, features and advantages of the present invention will become apparent from the following description of preferred embodiments of the present invention with reference to the accompanying drawings.

DESCRIPTION OF THE PREFERRED EMBODIMENTS

Figure 17A:
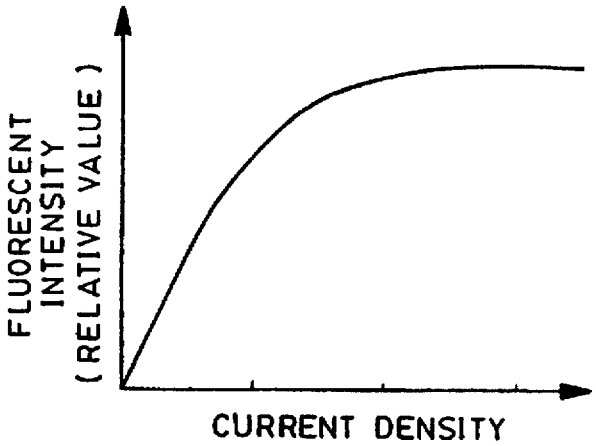
FIGS. 17A, 17B and 17C are respectively charts of the characteristics of a fluorescent screen used in a typical image display apparatus.
Figure 17B:
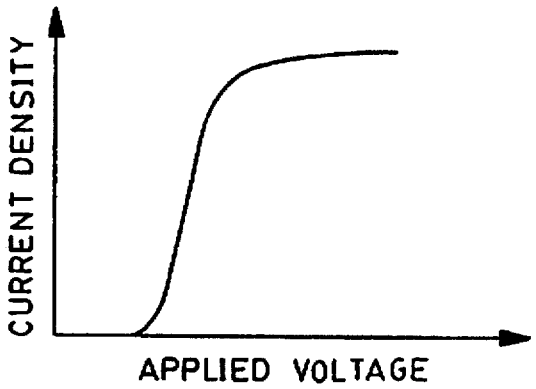
Figure 17C:
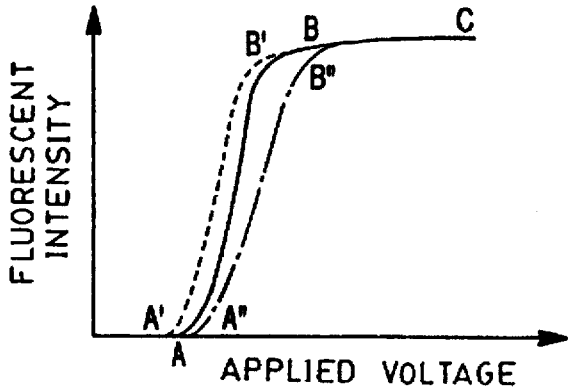

In accordance with the present invention, each picture element which forms a part of a display image is divided into a plurality of fine regions (or miniature luminescent units), and the fine regions are scanned by the electron beams emitted from the plurality of electron sources. A halftone can be reproduced by controlling the number of fine regions of each picture element which are allocated for luminescence. To this end, a switching operation is performed so as to turn on and off a solid-state beam generating device, and thus a phosphor coated on each of the fine regions is digitally controlled in a state wherein the quantity of electric charge imparted to the respective fine regions when the device is turned on is determined in accordance with the saturation limit at which the phosphor is saturated with electrons. Typically, the difficulties of the prior art are attributed to the use of the steep portion of the applied voltage-fluorescent intensity characteristics which is defined between A and B shown in FIG. 17C. Therefore, if the solid-state electron beam device is operated in the region defined between B and C which corresponds to a saturated state, the device can be stably operated irrespective of variations in the respective characteristics of individual electron sources. In addition, if the speed of scanning the aforementioned fine regions is synchronized with on-off control, it is possible to control the luminescence and non-luminescence of each of the fine regions. This enables control of the gradation of a display image within the area of each of the picture elements which respectively include the fine regions.

The preferred embodiments of the present invention will be described in detail below with reference to the accompanying drawings.

Figure 1:
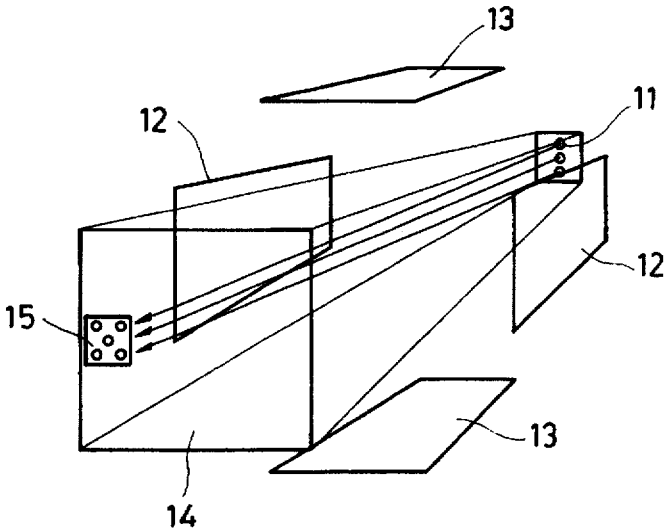
FIG. 1 is a schematic, perspective view of the basic construction of a first preferred embodiment of the present invention.

FIG. 1 is a schematic, perspective view of the basic construction of an image display apparatus constituting the first preferred embodiment of the present invention. As shown, the image display apparatus includes three electron sources 11 which are disposed in the vertical direction. The respective electron beams emitted from the electron sources 11 are controlled by a pair of horizontal deflection means 12 and another pair of vertical deflection means 13 so as to scan each picture element 15 formed on a fluorescent screen 14. In the first embodiment, the three electron beams arrayed in the vertical direction are caused to scan each of the picture elements 15 by a distance equivalent to three times as long as the respective diameters of the electron beams, thereby dividing the respective picture elements 15 into 3×3 fine regions, i.e. nine fine regions.

Figure 2:
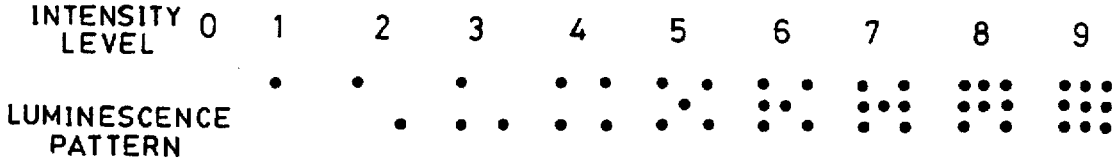
FIG. 2 is a view used as an aid in explaining the patterns of luminescence of each picture element of the first embodiment of the present invention.

As shown in FIG. 2 by way of example, it is possible to display a halftone in ten steps by changing the number of light-emitting ones of the thus-divided 9 fine regions.

Figure 3A:
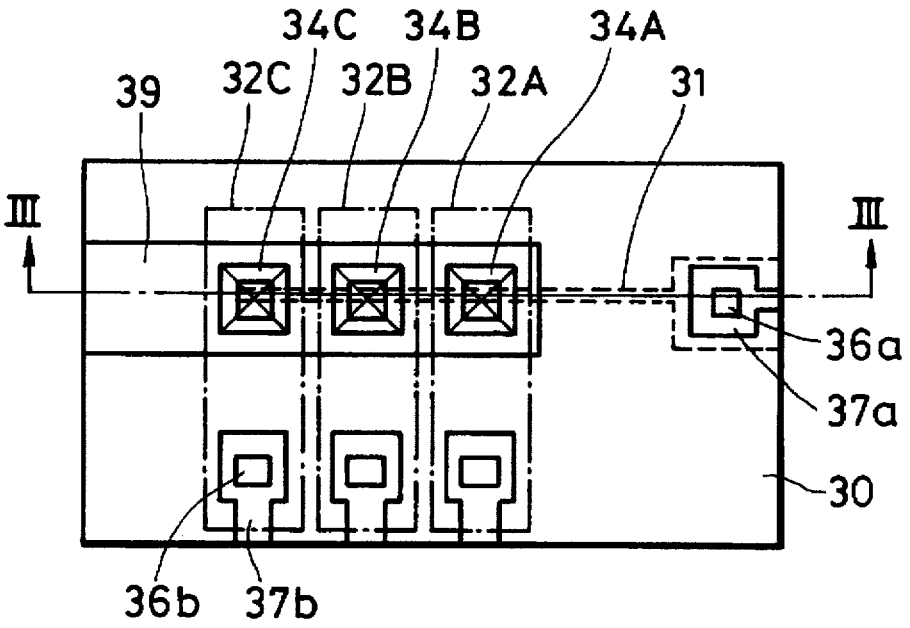
FIG. 3A is a diagrammatic, top plan view of a solid-state electron beam source used in the first embodiment.
Figure 3B:
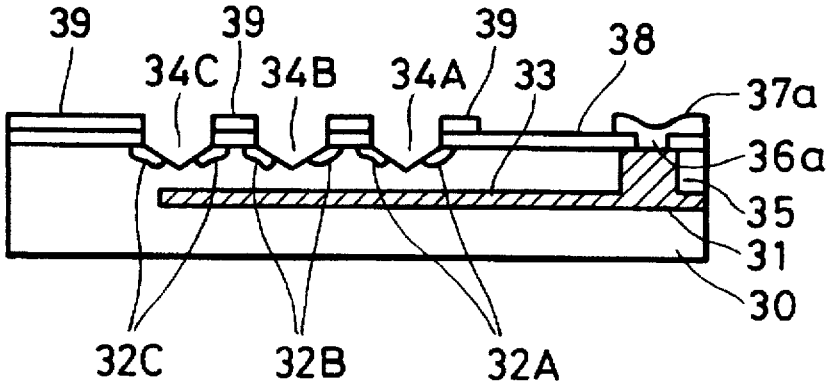
FIG. 3B is a sectional view taken along the line III—III of FIG. 3A.

FIG. 3A is a top plan view of an intergrated, solid-state electron beam source used in the first preferred embodiment of the present invention, and FIG. 3B is a sectional elevation taken along the line III—III of FIG. 3A. As shown, an n-type substrate is indicated at 30, and a p-type channel 31 having low ohmic resistance is formed as a common electrode in the the n-type substrate 30. In addition, the n-type substrate 30 has high-concentration doped n-type surface layers 32A, 32B and 32C which are formed as selectively-operable electrodes in such a manner that they cross the common electrode. Although no p-n junctions are exposed on the surface of the substrate 30, the respective depletion layers derived from the p-n junctions 30 are exposed to the outside through recesses 34A, 34B and 34C. In FIG. 3A, the low-ohmic-resistance p-type channel 31 is shown by a broken line and the high-concentration doped n-type surface layers 32A, 32B and 32C are shown by one-dot chain lines, the aforesaid n-type surface layers 32A to 32C and exposed portions of the silicon substrate 30 being illustrated in the respective recesses 34A, 34B and 34C. As shown in FIG.

3B, the bottoms of the recesses 34A, 34B and 34C each have a V-shaped form in cross-section, and the surface layers 32A to 32C and the exposed portions of the substrate 30 are respectively formed along the walls of the V-shaped recesses.

The low-ohmic-resistance p-type channel 31 is connected to a connecting electrode 37*a* via a contact region 35 and a contact window 36*a* while the high-concentration doped n-type surface layers 32A to 32C are respectively connected to associated connecting electrodes 37*b* via contact windows 36*b*. An insulating layer 38 is formed on the substrate 30, and an accelerating electrode 39 is formed on the insulating layer 38 such as to surround the recesses 34A, 34B and 34C.

In this arrangement, a voltage is applied to the connecting electrode 37*a* and one or more of the connecting electrodes 37*b* so as to develop an avalanche amplification at the associated one or ones of the p-n junctions 33 and at the same time a predetermined level of voltage is applied to the accelerating electrode 39. Thus, a desired one or ones of the negative electrodes 32A, 32B and 32C are selectively operated, thereby effecting electron emission. Incidentally, the detail mechanism of the electron emission is disclosed in the above noted specifications.

Figure 4:
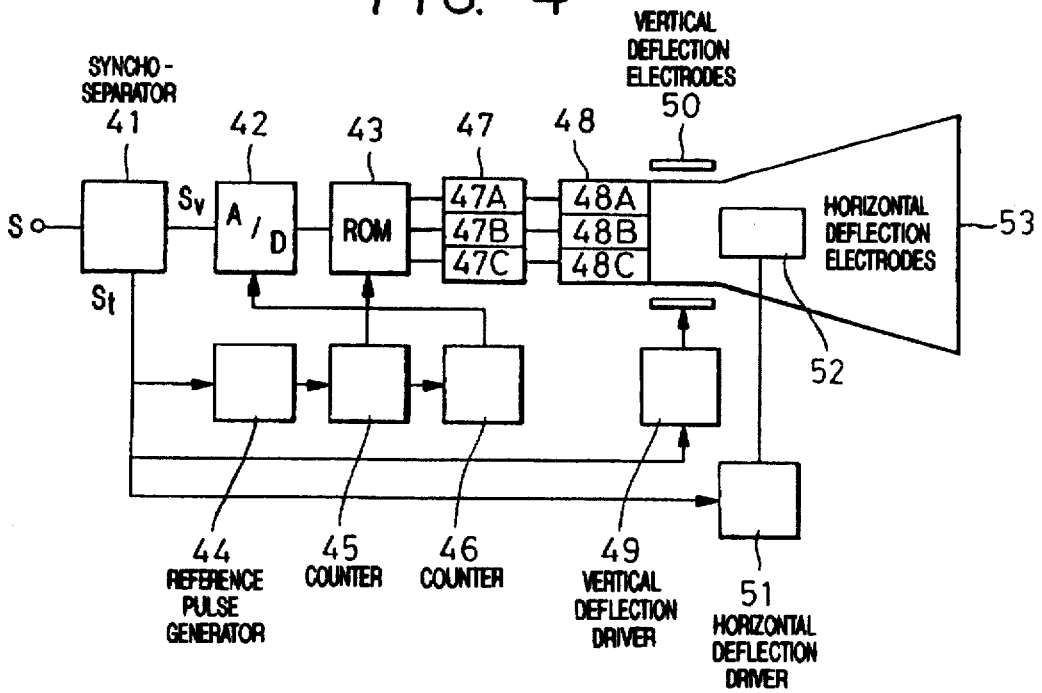
FIG. 4 is a block diagram of the first embodiment of the present invention.

FIG. 4 is a block diagram of one example of the construction of an image display apparatus which incorporates the first preferred embodiment, showing an example of reproduction of a video signal in accordance with the present invention. An incoming video signal S is seperated into a video signal $S_v$ and a synchronizing signal $S_r$ by a synchro-separating circuit 41. The video signal $S_v$ is digitized in an A/D converter circuit 42, and then input to high-order bits of a ROM table 43. In the meantime, the synchronizing signal $S_r$ triggers a reference-pulse generating circuit 44, and the thus-generated reference pulses are counted by a low-order counter 45. The resultant count value is input to low-order bits of the ROM table 43. The low-order counter 45 counts the reference pulses equivalent in number to the horizontal division of one picture element, and then outputs carry signals. A high-order counter 46 counts the carry signals, and outputs a sampling signal to the A/D converter circuit 42 at a desired timing.

A set of data listed in Table 1 is stored in the ROM table 43.

TABLE 1

| Electron Source | A | B | C |
|---|---|---|---|
| Low-order Bit / High-order Bit | 0 1 2 | 0 1 2 | 0 1 2 |
| 0 | 0 0 0 | 0 0 0 | 0 0 0 |
| 1 | 1 0 0 | 0 0 0 | 0 0 0 |
| 2 | 1 0 0 | 0 0 0 | 0 0 1 |
| 3 | 1 0 0 | 0 0 0 | 1 0 1 |
| 4 | 1 0 1 | 0 0 0 | 1 0 1 |
| 5 | 1 0 1 | 0 1 0 | 1 0 1 |
| 6 | 1 0 1 | 1 1 0 | 1 0 1 |
| 7 | 1 0 1 | 1 1 1 | 1 0 1 |
| 8 | 1 1 1 | 1 1 1 | 1 0 1 |
| 9 | 1 1 1 | 1 1 1 | 1 1 1 |

Reference is made to the data stored in the ROM table 43 in response to the inputs from the A/D converter circuit 42 and the low-order counter 45. As a result of this comparison, an electron-source on-off signal is output in accordance with the intensity level required by the luminescence of each picture element, and this provides any of the luminescence patterns shown in FIG. 2. The output of the ROM table 43 is amplified to a desired switching voltage by the electron-source driver 47 including driver portions 47A, 47B and 47C, and is input to associated connecting electrodes 48A, 48B and 48C of a solid-state electron beam source 48, thereby switching on and off the respective emissions of the three electron beams. A vertical deflection driver circuit 49 applies a predetermined level of drive voltage to a pair of vertical deflection electrodes 50 in accordance with the vertical synchronizing signal derived from the aforesaid synchronizing signal $S_r$. A horizontal deflection driver circuit 51 applies a predetermined level of voltage to a pair of horizontal deflection electrodes 52 in accordance with the horizontal synchronizing signal derived from the aforesaid synchronizing signal $S_r$. Under such control, the electron beams emitted from the solid-state electron beam source 48 are caused to scan a fluorescent screen 53 on which a graphic image is displayed.

In the first embodiment, the number of electron beam sources is equal to that of the vertical divisions of each picture element. However, the former may be increased to an integral multiple of the latter, thereby enabling a plurality of lines to be scanned at one time in each horizontal deflection.

As described above, the present invention succeeds in providing an image display apparatus including a solid-state electron beam generating device which is operated in its saturated region, the respective electron emissions corresponding to the three electron beams being effected under on-off control so as to vary the area of a luminescent portion of each picture element, thereby reproducing a halftone. Accordingly, the inventive apparatus is capable of easily reproducing a proper halftone irrespective of variations between the respective characteristics of the integrated electron emitting portions of the solid-state electron beam generating device.

The second preferred embodiment of the invention will be described below with reference to FIGS. 5 to 8 showing, respectively, the second preferred embodiment of the invention in which the fine regions (minimum luminescence units) constituting each picture element is equal in number to the electron beams.

Figure 5:
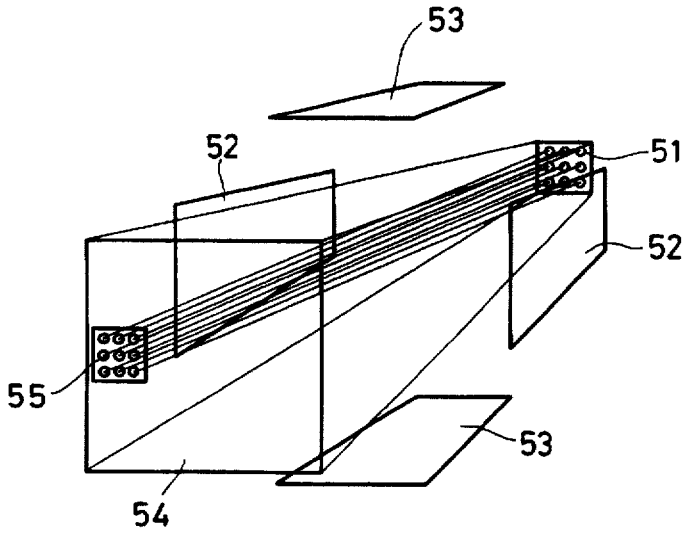
FIG. 5 is a schematic, perspective view of the basic construction of a second preferred embodiment of the present invention.

FIG. 5 is a schematic, perspective view of the basic construction of the second embodiment. As shown, the image display apparatus includes a solid-state electron beam generating device having 3×3, i.e., nine electron sources 51 arranged in a planar manner. The respective electron beams emitted from the electron sources 51 are controlled by a pair of horizontal deflection means 52 and another pair of vertical deflection means 53, thereby scanning each picture element 55 on a fluorescent screen 54. Each of the picture elements 55 is divided into 3×3 fine regions. Thus, the electron sources are equal in number to the fine regions, and the arrangement of the former corresponds to that of the latter. Accordingly, it is possible to select the numbers of luminescent and non-luminescent regions of each picture element by controlling ONs and OFFs of the respective electron sources.

Figure 6:
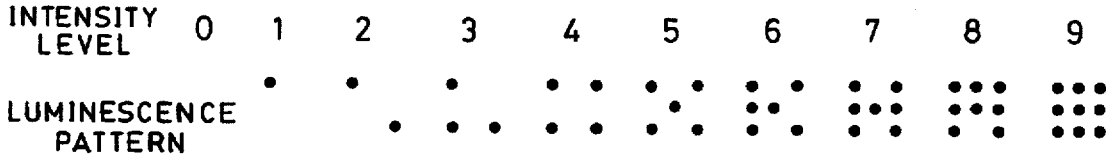
FIG. 6 is a view used as an aid in explaining the patterns of luminescence of each picture element of the second embodiment of the present invention.

As shown in FIG. 6 by way of example, it is possible to display a halftone in ten steps by changing the number of light-emitting ones of the thus-divided 9 fine regions.

Figure 7A:
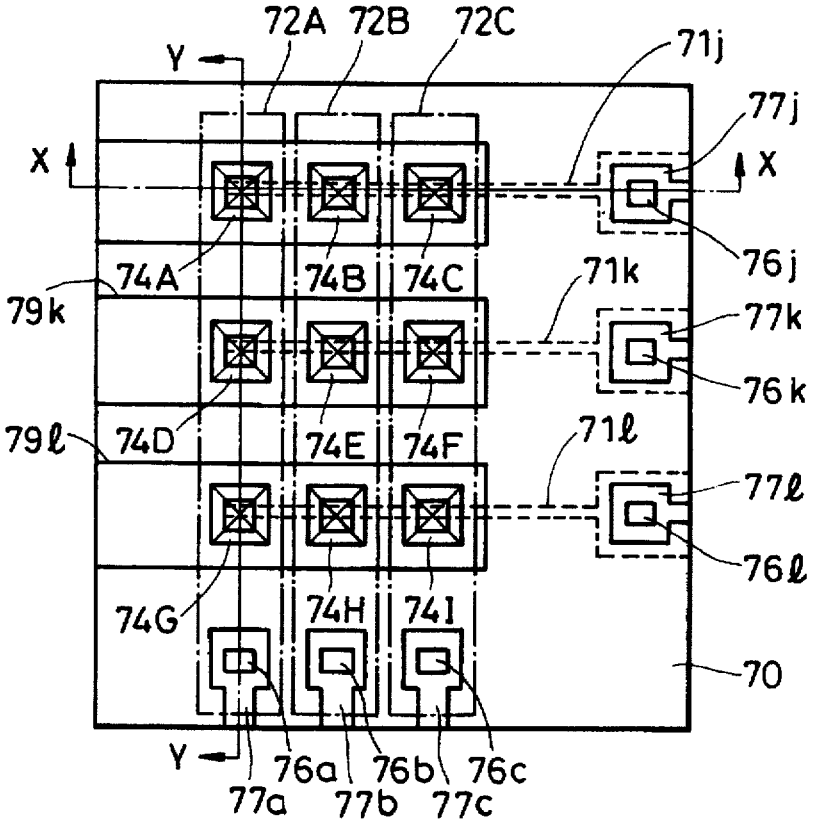
FIG. 7A is a diagrammatic, top plan view of a solid-state electron source used in the second embodiment.
Figure 7B:
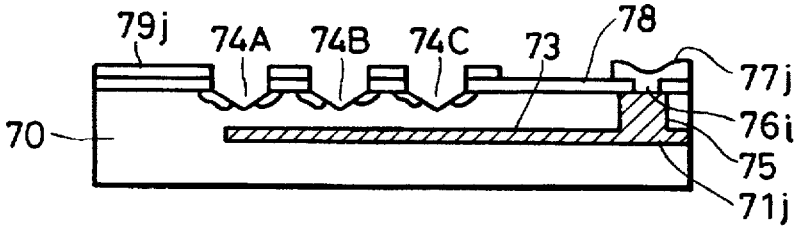
FIG. 7B is a sectional view taken along the line X—X of FIG. 7A.
Figure 7C:
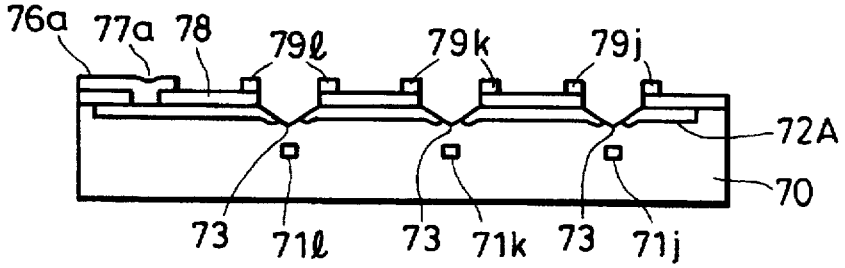
FIG. 7C is a sectional view taken along the line Y—Y of FIG. 7A.

FIG. 7A is a schematic, top plan view of an integrated, solid-state electron beam source which constitutes the second preferred embodiment of the prevent invention, FIG. 7B being a sectional view taken along the line X—X of FIG. 7A and FIG. 7C being a sectional view taken along the line Y—Y of FIG. 7A. As shown, an n-type substrate is indicated at 70, and p-type channels 71*j*, 71*k* and 711 each having low ohmic resistance are formed as common electrodes in the the n-type substrate 70. In addition, the n-type substrate 70 has high-concentration doped n-type surface layers 72A, 72B and 72C which are formed as selectively-operable electrodes in such a manner that they cross the common electrodes. Although no p-n junctions 73 are exposed on the surface of the substrate 70, the respective depletion layers derived from the p-n junctions 73 are exposed to the outside through recesses 74A to 74I. In FIG. 7A, the low-ohmic-resistance p-type channel 71*j*, 71*k* and 71*l* are respectively shown by broken lines and the high-concentration doped n-type surface layers 72A, 72B and 72C are respectively shown by one-dot chain lines, the aforesaid n-type surface layers 72A to 72C and exposed portions of the silicon substrate 70 being illustrated in the respective recesses 74A to 74I. As shown in FIGS. 7B and 7C, the bottoms of the recesses 74A to 74I each have a V-shaped form in cross-section, and the surface layers 72A to 72C and the exposed portions of the substrate 70 are respectively formed along the walls of the V-shaped recesses.

The low-ohmic-resistance p-type channels 71*j* to 71*l* are respectively connected to connecting electrodes 77*j*, 77*k* and 77*l* via corresponding contact regions 75 and contact windows 76*j*, 76*k* and 76*l* while the high-concentration doped n-type surface layers 72A, 72B and 72C are respectively connected to associated connecting electrodes 77*a*, 77*b* and 77*c* via contact windows 76*a*, 76*b* and 76*c*. An insulating layer 78 is formed on the substrate 70, and accelerating electrodes 79*j*, 79*k* and 79*l* are formed on the insulating layer 78 such as to surround the recesses 74A to 74I.

In this arrangement, voltages are applied to any one or more of the connecting electrodes 77*j* to 77*l* and corresponding one or ones of the connecting electrodes 77*a* to 77*c* so as to develop an avalanche amplification at an associated portion or portions of the p-n junctions 73 and at the same time voltages are applied at a predetermined level to the associated one or ones of the accelerating electrode 79*j*, 79*k* and 79*l*. Thus, a desired one or ones of the negative electrodes (A, B, C, . . . , I) corresponding to the recesses 74A to 74I are selectively operated, thereby effecting electron emission. Incidentally, the detail mechanism of the electron emission is disclosed in the above noted specifications.

Figure 8:
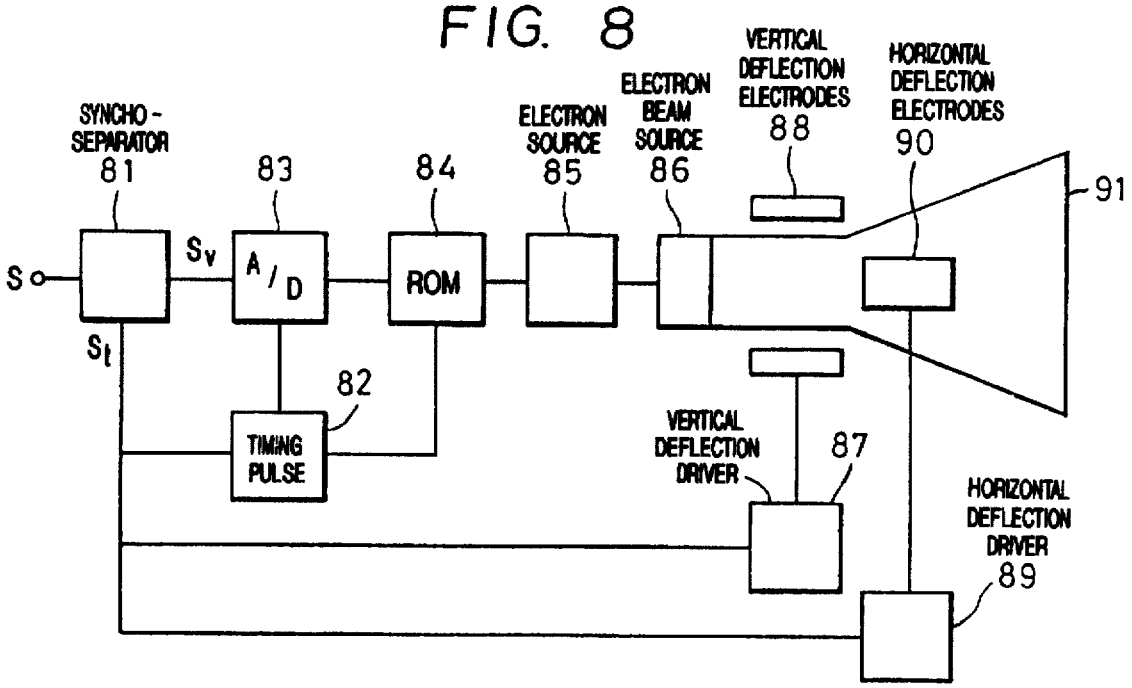
FIG. 8 is a block diagram of the second embodiment of the present invention.

FIG. 8 is a block diagram of one example of the construction of an image display apparatus which incorporates the second preferred embodiment, and showing an example of reproduction of a video signal in accordance with the present invention. An incoming video signal S is separated into a video signal $S_v$ and a synchronizing signal $S_r$ by a synchro-seperating circuit 81. The synchronizing signal $S_r$ triggers a timing-pulse generating circuit 82 to cause it to output a sampling pulse to an A/D converter circuit 83. The video signal $S_v$ is digitized in the A/D converter circuit 83, and then input to a ROM table 84.

The ROM table 84 stores therein nine kinds of data which are prepared in correspondence with the number of the electron sources (A, B, C, . . . , I), and the following contents listed in Table 2 are stored in the ROM table 84.

TABLE 2

| Electron Source | A | B | C | D | E | F | G | H | I |
|---|---|---|---|---|---|---|---|---|---|
| Intensity Level | | | | | | | | | |
| 0 | 0 | 0 | 0 | 0 | 0 | 0 | 0 | 0 | 0 |
| 1 | 1 | 0 | 0 | 0 | 0 | 0 | 0 | 0 | 0 |
| 2 | 1 | 0 | 0 | 0 | 0 | 0 | 0 | 0 | 1 |
| 3 | 1 | 0 | 0 | 0 | 0 | 0 | 1 | 0 | 1 |
| 4 | 1 | 0 | 1 | 0 | 0 | 0 | 1 | 0 | 1 |
| 5 | 1 | 0 | 1 | 0 | 1 | 0 | 1 | 0 | 1 |
| 6 | 1 | 0 | 1 | 1 | 1 | 0 | 1 | 0 | 1 |
| 7 | 1 | 0 | 1 | 1 | 1 | 1 | 1 | 0 | 1 |
| 8 | 1 | 1 | 1 | 1 | I | 1 | 1 | 0 | 1 |
| 9 | 1 | 1 | 1 | 1 | 1 | 1 | 1 | 1 | 1 |

Reference is made to the data stored in the ROM table 84 on the basis of the inputs from the A/D converter circuit 83 and the timing-pulse generating circuit 82. As a result of the comparison, an on-off timing signal for the respective electron sources is output to an electron-source driver 85 in accordance with the intensity level required by the luminescence of each picture element. The electron source driver 85 amplifies the timing signal to a voltage level at which the fluorescent intensity of the phospher is saturated. The amplified signal is input to connecting electrodes A, B, C, . . . (not shown) of a solid-state electron beam source 86, and thus the respective emissions of electron beams are turned on and off, thereby obtaining any of the luminescence patterns shown in FIG. 6. A vertical deflection driver circuit 87 applies a predetermined level of drive voltage to a pair of vertical deflection electrodes 88 in accordance with the vertical synchronizing signal derived from the aforesaid synchronizing signal $S_r$. A horizontal deflection driver circuit 89 applies a predetermined level of voltage to a pair of horizontal deflection electrodes 90 (one of which is shown) in accordance with the horizontal synchronizing signal derived from the aforesaid synchronizing signal $S_r$. Under such control, the electron beams emitted from the solid-state electron beam source 86 are caused to scan a fluorescent screen 91 on which a graphic image is displayed.

In the second embodiment, the number of electron beam sources is equal to that of the divisions of each picture element. However, the former may be increased to an integral multiple of the latter, thereby enabling a plurality of lines of an image to be reproduced at one time in each horizontal deflection. In this case, since horizontal scanning synchronization is prolonged, it is possible to prolong the period during which the electron beams illuminate each picture element, and this realizes a very fine graphic display image.

As described above, the present invention succeeds in providing the image display apparatus including the solid-state electron beam generating device which is operated in its saturated region, the respective electron emissions corresponding to the electron beams being effected under on-off control so as to vary the area of a luminescent portion of each picture element, thereby reproducing a halftone. Accordingly, the inventive apparatus is capable of easily reproducing a proper halftone irrespective of variations between the respective characteristics of the integrated electron emitting portions of the solid-state electron beam generating device.

Figure 9:
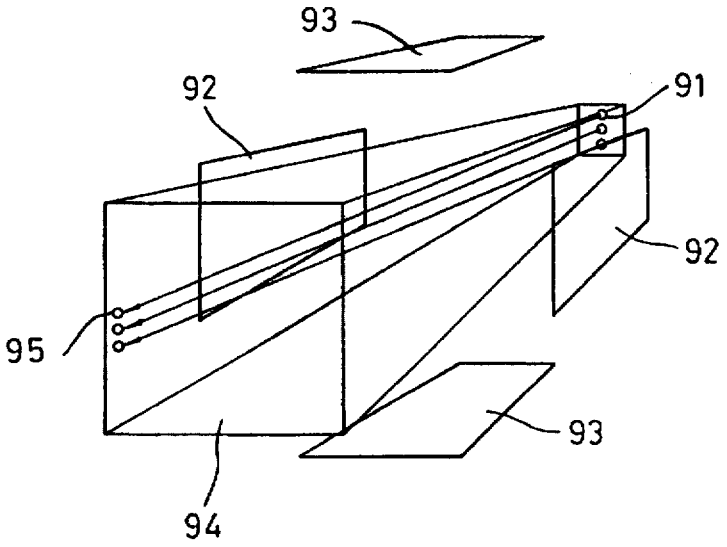
FIG. 9 is a schematic, perspective view of the basic construction of a third preferred embodiment of the present invention.
Figure 10:
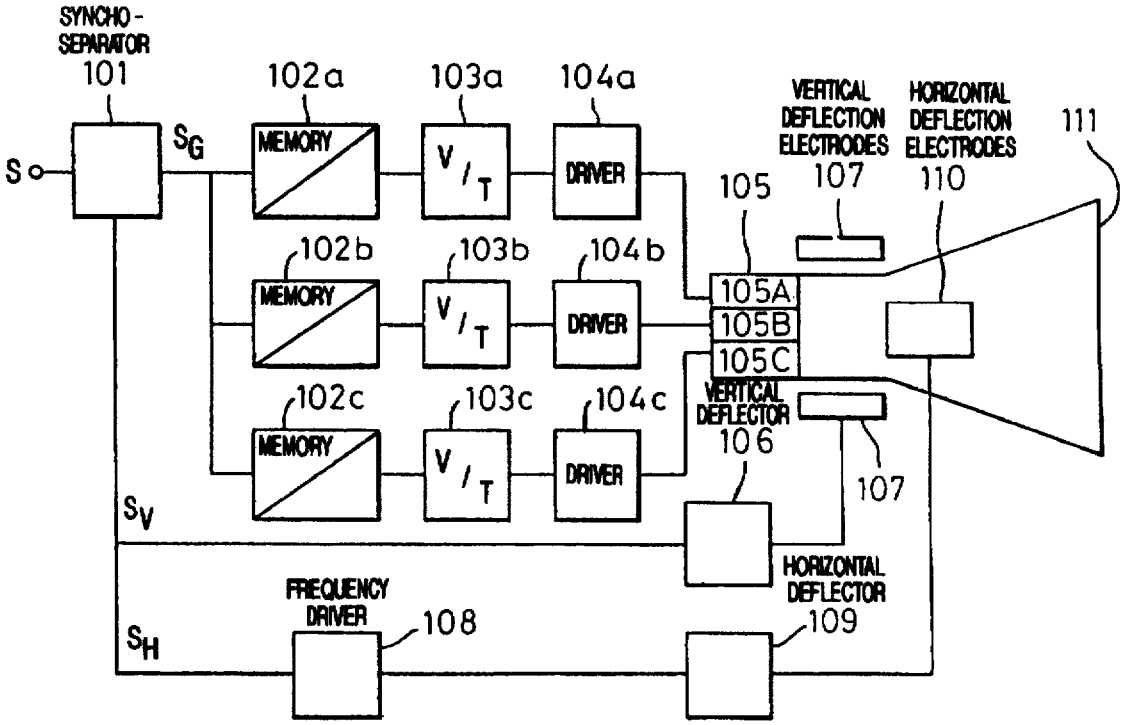
FIG. 10 is a block diagram of the third embodiment of the present invention.
Figure 11:
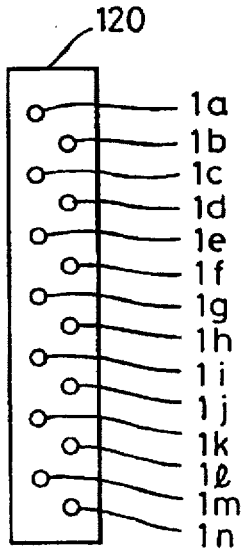
FIG. 11 is a schematic, front elevational view of one example of a solid-state electron source used in the third embodiment.

FIGS. 9 to 11 shows an image display apparatus which constitutes the third embodiment and in which the period available for the emission of electron beams is capable of being controlled in accordance with information representing the gradation of an image to be displayed.

FIG. 9 is a schematic, perspective view of the basic construction of an image display apparatus incorporating the third embodiment of the present invention. As shown, the image display apparatus includes a solid-state electron beam generating device having three electron sources 91 which are disposed in the vertical direction. The respective electron beams emitted from the electron sources 91 are controlled by a pair of horizontal deflection means 92 and another pair of vertical deflection means 93, and are caused to horizontally scan each picture element 95 formed on a fluorescent screen 94. Since each of the electron beams forms one scanning line, three lines can be scanned at the same time in each horizontal scanning, and thus horizontal scanning synchronization can be made three times as long as a typical one. This facilitates reproduction of a halftone.

It is to be noted that the device shown in FIGS. 3A and 3C may be used for the solid-state electron source of the image display apparatus constituting this embodiment.

FIG. 10 is a block diagram of one example of the construction of the image display apparatus which constitutes the third embodiment, showing an example of reproduction of a video signal which is carried out in this embodiment. An incoming video signal S is separated into a video signal $S_G$, a vertical synchronizing signal $S_V$ and a horizontal synchronizing signal $S_H$ by a synchro-separating circuit 101. The video signal $S_G$ corresponding to three continuous lines is temporarily stored in three line memories 102*a*, 102*b* and 102*c*. The line memories 102*a*, 102*b* and 102*c* each have a storage capacity for two lines, and alternately perform the reading and writing of the video signal $S_G$. Respective signals are read from the line memories 102*a*, 102*b* and 102*c* into V/T transducers 103*a*, 103*b* and 103*c*, in which the voltages thereof are converted into corresponding pulse widths. The pulse-width signals are further converted into drive pulses by electron source drivers 104*a*, 104*b* and 104*c*, respectively, and are input to connecting electrodes 105A, 105B and 105C of a solid-state electron beam generating device 105. Thus, the respective periods during which the emission of electron beams is "ON" are controlled in accordance with the incoming video signals.

In the meantime, the vertical synchronizing signal $S_V$ triggers the vertical deflection circuit 106 to cause it to apply a vertical deflection waveform to a pair of vertical deflection electrodes 107. The frequency of the horizontal synchronizing signal $S_H$ is divided by the number of the vertically arrayed electron beams in a frequency divider circuit 108, and then a horizontal deflection circuit 109 is triggered, thereby applying a horizontal deflection waveform to a pair of horizontal deflection electrodes 110. Under such control, the electron beams emitted from the solid-state electron beam generating device 105 are caused to scan a fluorescent screen 111 on which a graphic image is displayed.

FIG. 11 is a diagram showing another example of the arrangement of the solid-state electron beam generating device 111. As shown, a plurality of electron sources 1*a* to 1*n* are disposed in a zigzag manner on a substrate 120. This arrangement realizes increased fineness of the vertical pitches of the electron sources and enables sufficient widening of the intervals between the respective sources. Thus, the formation of the electron sources becomes easy and mutual interference therebetween can also be inhibited.

As described above, the present invention succeeds in providing the image display apparatus including the solid-state electron beam generating device which is operated in its saturated region, the respective electron emissions corresponding to the electron sources being effected under on-off control so as to vary the area of a luminescent portion of each picture element, thereby reproducing a halftone. Accordingly, the inventive apparatus is capable of easily reproducing a proper halftone irrespective of variations between the respective characteristics of the integrated electron emitting portions of the solid-state electron beam generating device.

The fourth embodiment will be described below with reference to FIGS. 12 to 16.

Figure 12:
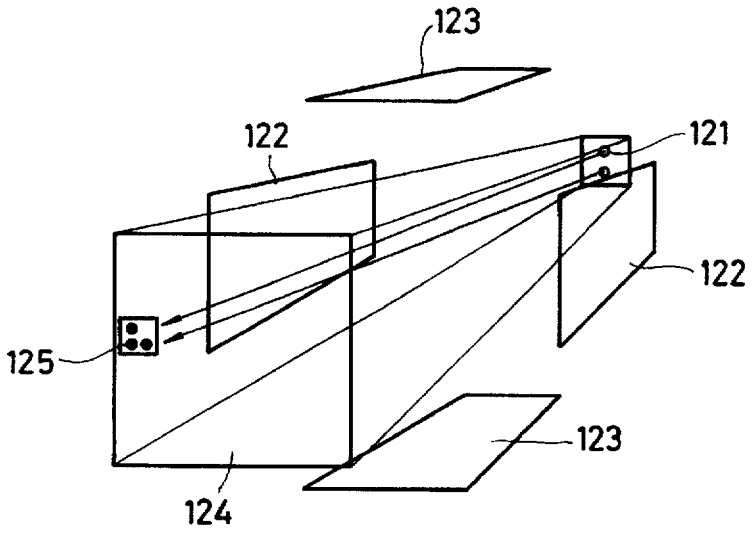
FIG. 12 is a schematic, perspective view of the basic construction of a fourth preferred embodiment of the present invention.

FIG. 12 is a schematic, perspective view of the basic construction of an image display apparatus constituting the fourth preferred embodiment of the present invention. As shown, the image display apparatus includes two electron sources 121 which are disposed in the vertical direction. The respective electron beams emitted from the electron sources 121 are controlled by a pair of horizontal deflection means 122 and another pair of vertical deflection means 123 so as to scan each picture element 125 formed on a fluorescent screen 124. Each of the picture elements 125 is divided into 2×2 fine regions. Thus, the electron sources are equal in number to the fine regions, and the vertical arrangement of the former corresponds to that of the latter. Accordingly, it is possible to select the respective numbers of luminescent and non-luminescent portions of the picture elements 125 by controlling ONs and OFFs of each of the respective electron sources 121. In addition, if the period available for electron emission is switched between two different lengths, the period allocated for luminescence can also be switched in two steps.

Figure 13:
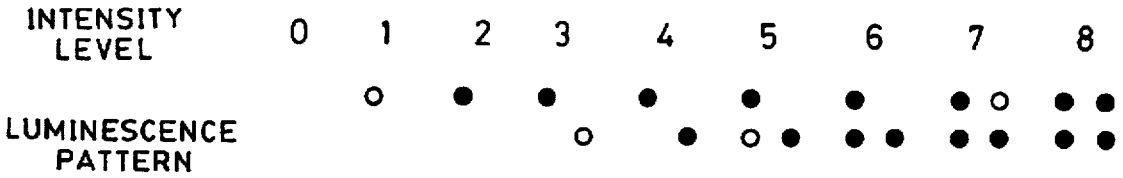
FIG. 13 is a view used as an aid in explaining the patterns of luminescence of each picture element of the fourth embodiment of the present invention.

As shown in FIG. 13 by way of example, it is possible to display a halftone in nine steps by means of the four divided fine regions by changing the number of fine regions allocated for luminescence and the period of luminescence of each of the fine regions. In FIG. 13, each black round mark represents a long period of luminescence while each white round mark represents a short period of luminescence.

Figure 14A:
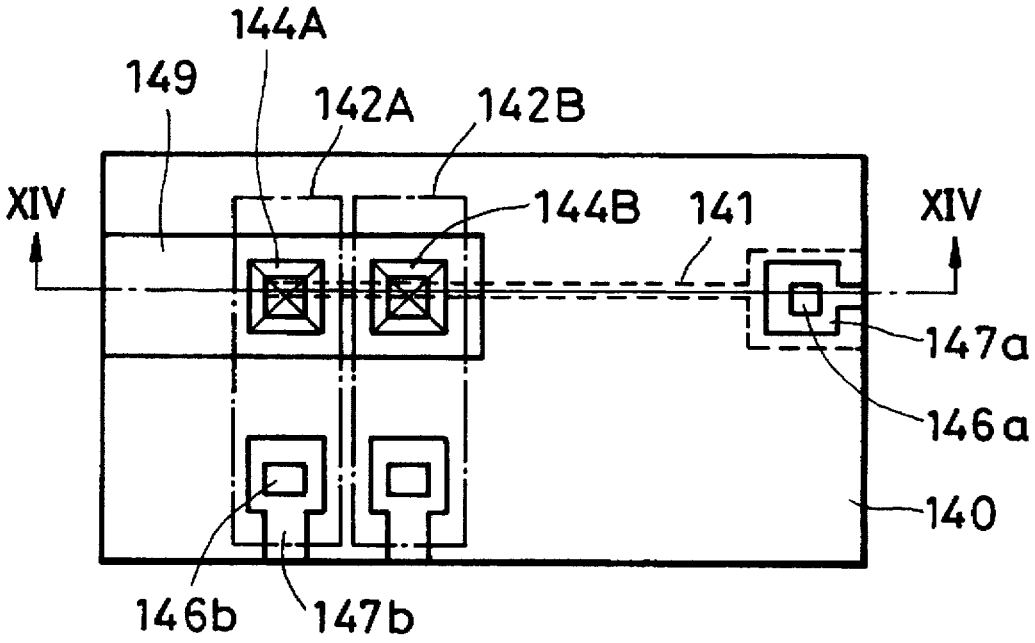
FIG. 14A is a diagrammatic, top plan view of a solid-state electron beam source used in the fourth embodiment.
Figure 14B:
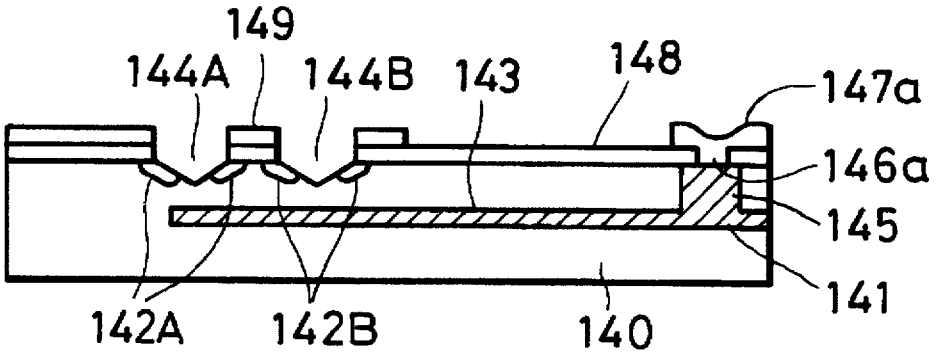
FIG. 14B is a sectional view taken along the line XIV—XIV of FIG. 14A.

FIG. 14A is a top plan view of an intergrated, solid-state electron beam source used in the fourth preferred embodiment of the present invention, and FIG. 14B is a sectional elevation taken along the line XIV—XIV of FIG. 14A. As shown, an n-type substrate is indicated at 140, and a p-type channel 141 having low ohmic resistance is formed as a common electrode in the n-type substrate 140. In addition, the n-type substrate 140 has high-concentration doped n-type surface layers 142A and 142B which are formed as selectively-operable electrodes in such a manner that they cross the common electrode. Although no p-n junction 143 is exposed on the surface of the substrate 140, the respective depletion layers derived from the p-n junction 143 are exposed to the outside through recesses 144A and 144B. In FIG. 14A, the low-ohmic-resistance p-type channel 141 is shown by a broken line and the high-concentration n-type surface layers 142A and 142B are shown by one-dot chain lines, the aforesaid n-type surface layers 142A and 142B and exposed portions of the silicon substrate 140 being illustrated in the respective recesses 144A and 144B. As shown in FIG. 14B, the bottoms of the recesses 144A and 144B each have a V-shaped form in cross-section, and the surface layers 142A and 142B and the exposed portions of the substrate 140 are respectively formed along the walls of the V-shaped recesses.

The low-ohmic-resistance p-type channel 141 is connected to a connecting electrode 147*a* via a contact region 145 and a contact window 146a while the high-concentration doped n-type surface layers 142A and 142B are respectively connected to associated connecting electrodes 147*b* via contact windows 146*b*. An insulating layer 148 is formed on the substrate 140, and an accelerating electrode 149 is formed on the insulating layer 148 such as to surround the recesses 144A and 144B.

In this arrangement, voltage is applied to the connecting electrode 147*a* and either of the connecting electrodes 147*b* so as to develop an avalanche amplification at the p-n junction 143 and at the same time a predetermined level of voltage is applied to the accelerating electrode 149. Thus, a desired one or ones of the negative electrodes A and B are selectively operated, thereby effecting electron emission. Incidentally, the detail mechanism of the electron emission is disclosed in the above noted specifications.

Figure 15:
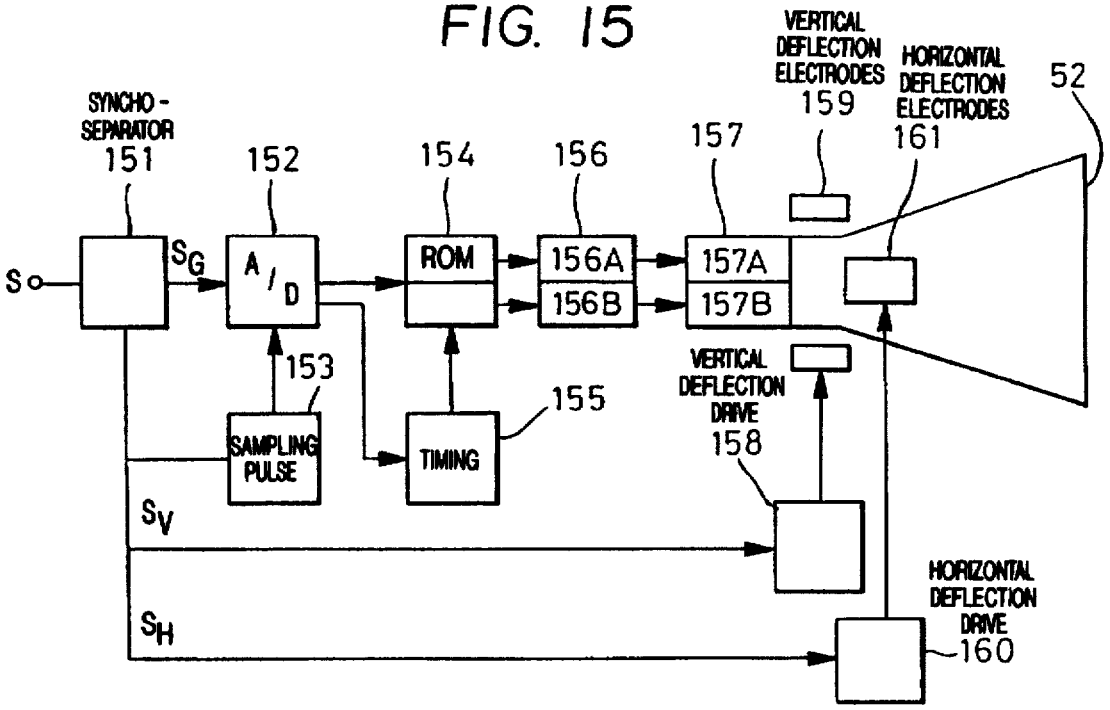
FIG. 15 is a block diagram of the fourth embodiment.

FIG. 15 is a block diagram of one example of the construction of an image display apparatus which incorporates the fourth preferred embodiment. An incoming video signal S is separated into a video signal $S_G$ and a synchronizing signal $S_T$ by a synchro-separating circuit 151. The video signal $S_G$ is input to an A/D converter circuit 152. The synchronizing signal $S_T$ is input to a sampling-pulse generating circuit 153, and thus the circuit 153 is triggered to output a sampling pulse to an A/D converter circuit 152. The A/D converter circuit 152 digitizes the video signal $S_G$ in response to the sampling pulse, and inputs the result to high-order bits of a ROM table 154. If $2T_W$ represents the intervals between the sampling pulses, when a timing circuit 155 receives a signal representing the end of an A/D conversion from the A/D converter circuit 152, the circuit 155 generates two output pulses during each interval $T_W$. The intervals between the two output pulses are set to $T_D$ ($T_D<T_W$), and the pulses are input to low-order bits of the ROM table 154.

A set of data listed in Table 3 is stored in the ROM table 154.

TABLE 3

| Electron Source | A | B |
|---|---|---|
| Low-order Bit | 0 1 2 3 | 0 1 2 3 |
| High-order Bit (Intensity) | | |
| 0 | 0 0 0 0 | 0 0 0 0 |
| 1 | 1 0 0 0 | 0 0 0 0 |
| 2 | 1 1 0 0 | 0 0 0 0 |
| 3 | 1 1 0 0 | 0 0 1 0 |
| 4 | 1 1 0 0 | 0 0 1 1 |
| 5 | 1 1 0 0 | 1 0 1 1 |
| 6 | 1 1 0 0 | 1 1 1 1 |
| 7 | 1 1 1 0 | 1 1 1 1 |
| 8 | 1 1 1 1 | 1 1 1 1 |

Reference is made to data stored at a series of four addresses in the ROM table 154 on the basis of the signal from the A/D converter circuit 152 and the signal from the timing circuit 155. Thus, an electron-source on-off signal is output in accordance with the intensity level required by the luminescence of each picture element. The output from the ROM table 154 is amplified by electron source drivers 156A and 156B up to a voltage level at which the fluorescent intensity of the phosphor is saturated, and then is input to connecting electrodes 157A and 157B of a solid-state electron beam source 157, thereby switching on and off the respective emissions of the two electron beams. This provides the luminescence patterns shown in FIG. 13. A vertical deflection driver circuit 158 applies a predetermined level of drive voltage to a pair of vertical deflection electrodes 159 in accordance with a vertical synchronizing signal $S_V$ derived from the aforesaid synchronizing signal $S_T$. A horizontal deflection driver circuit 160 applies a predetermined level of drive voltage to a pair of horizontal deflection electrodes 161 in accordance with a horizontal synchronizing signal $S_H$ derived from the aforesaid synchronizing signal $S_T$. Under such control, the electron beams emitted from the solid-state electron beam source 157 (electron sources A and B) are caused to scan a fluorescent screen 162 on which a graphic image is displayed.

Figure 16A:
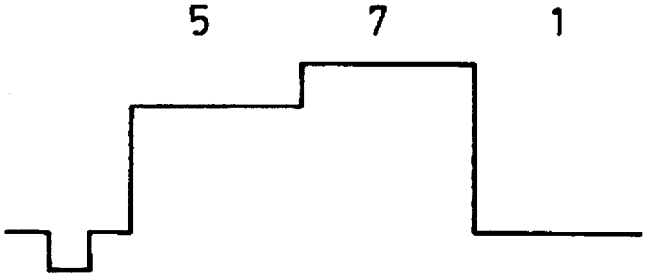
FIGS. 16A, 16B, 16C and 16D are respectively timing charts used as an aid in explaining the operation of the fourth embodiment.
Figure 16B:
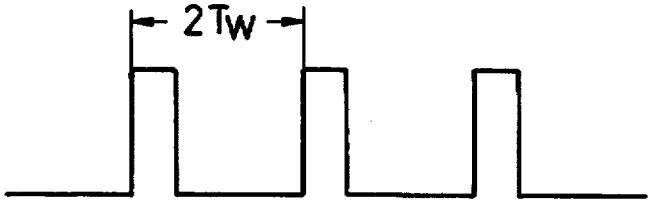
Figure 16C:
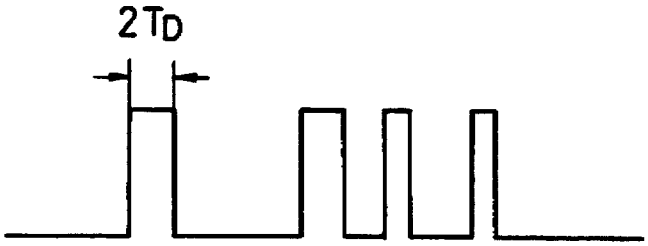
Figure 16D:
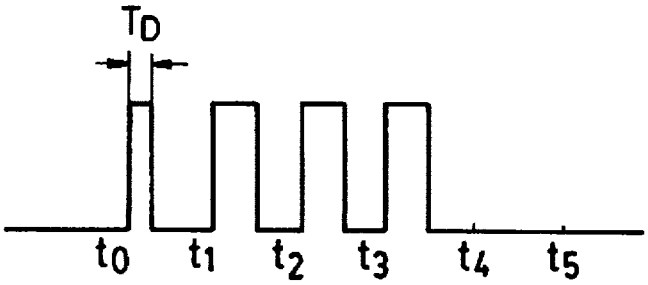

FIGS. 16A to 16D are timing charts respectively showing the waveforms used in the fourth embodiment. FIG. 16A shows the waveform of the incoming video signal S while the first three picture elements are scanned during one horizontal scanning period, FIG. 16B showing the waveform of sampling pulses, FIG. 16C showing the waveform of drive pulses applied to the electron source A and FIG. 16D showing the waveform of drive pulses applied to the electron source B. First, a signal indicative of an intensity level "5" is sampled in response to a sampling pulse at a time $t_0$ (FIG. 16B), and electrons are emitted from the electron source A during a period equivalent to a pulse width of $2T_D$ (FIG. 16C). Simultaneously, the electron source B emits electrons during a period equivalent to a pulse width of $T_D$ (FIG. 16D). At a time $T_1$ after a period $T_W$ has elapsed, the electron source B is again switched on, and remains on during the following period of $2T_D$. As shown, subsequently, a signal indicative of an intensity level "7" and a signal indicative of an intensity level "1" are sampled in this order.

In the fourth embodiment as well, the number of the electron beam sources is equal to that of the vertical divisions of each picture element. However, the former may be increased to an integral multiple of the latter, thereby enabling a plurality of lines to be scanned at one time in each horizontal deflection.

As described above, the present invention succeeds in providing the image display apparatus including the solid-state electron beam generating device which is operated in its saturated region, the respective electron emissions being effected under on-off control so as to vary the area of a luminescent portion of each picture element, thereby reproducing a halftone. Accordingly, the inventive apparatus is capable of easily reproducing a proper halftone irrespective of variations between the respective characteristics of the integrated electron emitting portions of the solid-state electron beam generating device.

What is claimed is:

1. An image display apparatus in which luminance contrast is produced by the scanning of electron beams, comprising:

a phosphor display including a plurality of picture elements each having a plurality of miniature luminescent units which respectively exhibit luminescence in response to the application of one of a plurality of corresponding electron beams, said picture elements being arranged in lines and columns;

solid-state electron-beam generating means having a plurality of electron sources for generating the plurality of electron beams which respectively energize said plurality of miniature luminescent units in each of said picture elements, wherein said solid-state electron-beam generating means is impressed with a predetermined voltage such that said solid-state electron beam generating means operates substantially in its saturated region thereby producing the plurality of corresponding electron beams with minimum variation therebetween, and the fluorescent intensity of each respectively energized miniature luminescent unit of said phosphor display will be substantially the same; and control means for controlling said solid-state electron-beam generating means in accordance with a gradation signal to selectively actuate said plurality of electron sources such that the number of said miniature luminescent units within each picture element that are simultaneously energized by a corresponding electron beam is varied to regulate the fluorescent intensity of each of said picture elements, wherein the luminance contrast of said image display apparatus is controlled by varying the area of the luminescent portion of each picture element.

2. An image display apparatus according to claim 1, wherein said electron-beam generating means includes a plurality of electron sources equivalent in number to the lines or the columns in which said plurality of miniature luminescent units are arranged.

3. An image display apparatus according to claim 1, wherein said electron-beam generating means includes a plurality of electron sources equivalent in number to the number of said plurality of miniature luminescent units defined in each of said picture elements.

4. An image display apparatus according to claim 1, wherein said electron-beam generating means includes an electron source arranged to constantly emit electron beams consisting of a fixed quantity of electrons.

5. An image display apparatus according to claim 1 further including:

first deflection means for deflecting said electron-beams emitted from said electron sources of electron-beam generating means in the direction of the line of said picture elements as arranged therein; and second deflection means for deflecting said electron beams emitted from said electron sources of said electron-beam generating means in the direction of the column of said picture elements as arranged therein.

6. An image display apparatus according to claim 1, wherein said electron-beam generating means includes a plurality of electron sources arranged to emit electron beams consisting of an equal quantity of electrons.

7. An image display apparatus according to claim 1, wherein the apparatus is operated in a vacuum.

8. An image display apparatus according to claim 1, wherein said control means includes memory means, containing data relating to the number of said electron sources and intensity levels, for outputting a signal identifying an intensity level of each of said luminescent units of said picture elements.

9. An image display apparatus according to claim 8, wherein said control means further includes an A/D converter, a timing-pulse generator and an electron source driver, wherein said A/D converter receives a sampling pulse from said timing-pulse generator and outputs a digital video signal to said memory means, said timing-pulse generator inputs a timing-pulse signal to said memory means, and said memory means outputs on-off signals to said electron source driver.

10. An image display apparatus in which luminance contrast is produced by the scanning of electron beams, comprising:

a phosphor display including a plurality of picture elements each having a plurality of miniature luminescent units which respectively exhibit luminescence in response to the application of one of a plurality of corresponding electron beams, said picture elements being arranged in lines and columns;

solid-state electron-beam generating means having a plurality of electron sources for generating the plurality of electron beams which respectively energize said plurality of miniature luminescent units in each of said picture elements, wherein said solid-state electron-beam generating means is impressed with a predetermined voltage such that said solid-state electron beam generating means operates substantially in its saturated region thereby producing the plurality of corresponding electron beams with minimum variation therebetween, and the fluorescent intensity of each respectively energized miniature luminescent unit of said phosphor display will be substantially the same; and control means for controlling said solid-state electron-beam generating means in accordance with a gradation signal to selectively actuate said plurality of electron sources such that the period of time available for the emission of the plurality of electron beams to be emitted to each of said corresponding picture elements is varied to regulate the fluorescent intensity of each of said picture elements.

11. An image display apparatus according to claim 10, wherein said electron-beam generating means includes a plurality of electron sources equivalent in number to the lines or the columns in which said plurality of miniature luminescent units are arranged.

12. An image display apparatus according to claim 10, wherein said electron-beam generating means includes a plurality of electron sources equivalent in number to the number of said plurality of miniature luminescent units defined in each of said picture elements.

13. An image display apparatus according to claim 10 further including:

first deflection means for deflecting said electron beams emitted from said electron sources of said electron-beam generating means in the direction of the line of said picture elements as arranged therein; and second deflection means for deflecting said electron beams emitted from said electron sources of said electron-beam generating means in the direction of the column of said picture elements as arranged therein.

14. An image display apparatus according to claim 10, wherein the apparatus is operated in a vacuum.

15. An image display apparatus according to claim 10, wherein said electron-beam generating means includes an electron source arranged to constantly emit electron beams consisting of a fixed quantity of electrons.

16. An image display apparatus according to claim 10, wherein said electron-beam generating means includes a plurality of electron sources arranged to emit electron beams consisting of an equal quantity of electrons.

17. An image display apparatus according to claim 10, wherein said control means includes a multiple line memory, a V/T transducer, and an electron source driver, with said multiple line memory receiving a video signal and outputting a signal to said V/T transducer, which outputs a pulse-width signal to said electron source driver, which in turn outputs drive pulses to said electron beam generating means.

18. An image display apparatus in which luminance contrast is produced by the scanning of electron beams, comprising:

a phosphor display including a plurality of picture elements each having a plurality of miniature luminescent units which respectively exhibit luminescence in response to the application of one of a plurality of corresponding electron beams, said picture elements being arranged in lines and columns;

solid-state electron-beam generating means having a plurality of electron sources for generating the plurality of electron beams which respectively energize said plurality of miniature luminescent units in each of said picture elements, wherein said solid-state electron-beam generating means is impressed with a predetermined voltage such that said solid-state electron beam generating means operates substantially in its saturated region thereby producing the plurality of corresponding electron beams with minimum variation therebetween, and the fluorescent intensity of each respectively energized miniature luminescent unit of said phosphor display will be substantially the same; and control means for controlling said solid-state electron-beam generating means in accordance with a gradation signal to selectively actuate said plurality of electron sources such that the number of said miniature luminescent units within each picture element that are simultaneously energized by a corresponding electron beam is varied and to selectively actuate said plurality of electron sources such that the period of time available for the emission of the plurality of electron beams to be emitted to each of said corresponding picture elements is varied to regulate the fluorescent intensity of each of said picture elements.

19. An image display apparatus according to claim 18, wherein said electron-beam generating means includes a plurality of electron sources equivalent in number to the number of said plurality of miniature luminescent units defined in each of said picture elements.

20. An image display apparatus according to claim 18 further including:

first deflection means for deflecting said electron beams emitted from said electron sources of said electron-beam generating means in the direction of said line of the picture elements as arranged therein; and second deflection means for deflecting said electron beams emitted from said electron sources of said electron-beam generating means in the direction of the column of said picture elements as arranged therein.

21. An image display apparatus according to claim 18, wherein said electron-beam generating means includes a plurality of electron sources equivalent in number to the lines or the columns in which said plurality of miniature luminescent units are arranged.

22. An image display apparatus according to claim 18, wherein said electron-beam generating means includes an electron source arranged to constantly emit electron beams consisting of a fixed quantity of electrons.

23. An image display apparatus according to claim 18, wherein said electron-beam generating means includes a plurality of electron sources arranged to emit electron beams consisting of an equal quantity of electrons.

24. An image display apparatus according to claim 18, wherein the apparatus is operated in a vacuum.

25. An image display apparatus according to claim 18, wherein said control means includes memory means, containing data relating to the number of said electron sources and intensity levels, for outputting a signal identifying an intensity level of each of said luminescent units of said picture elements.

26. An image display apparatus according to claim 25, wherein said control means further includes an A/D converter, a timing-pulse generator and an electron source driver, wherein said A/D converter receives a sampling pulse from said timing-pulse generator and outputs a digital video signal to said memory means, said timing-pulse generator inputs a timing-pulse signal to said memory means, and said memory means outputs on-off signals to said electron source driver.

27. An image display apparatus according to claim 18, wherein said control means includes a multiple line memory, a V/T transducer, and an electron source driver, with said multiple line memory receiving a video signal and outputting a signal to said V/T transducer, which outputs a pulse-width signal to said electron source driver, which in turn outputs drive pulses to said electron beam generating means.

28. An image display apparatus in which luminance contrast is produced by electron beams, comprising:

a phosphor display including a plurality of picture elements each having a plurality of miniature luminescent units which respectively exhibit luminescence in response to the application of one of a plurality of corresponding electron beams, said picture elements being arranged in lines and columns;

solid-state electron-beam generating means having a plurality of electron sources for generating the plurality of electron beams which respectively energize said plurality of miniature luminescent units in each of said picture elements, wherein said solid-state electron-beam generating means is impressed with a predetermined voltage such that said solid-state electron beam generating means operates substantially in its saturated region thereby producing the plurality of corresponding electron beams with minimum variation therebetween, and the fluorescent intensity of each respectively energized miniature luminescent unit of said phosphor display will be substantially the same; and control means for controlling said solid-state electron-beam generating means in accordance with a gradation signal to selectively actuate said plurality of electron sources such that the number of said miniature luminescent units within each picture element that are simultaneously energized by a corresponding electron beam is varied to regulate the fluorescent intensity of each of said picture elements.

29. An image display apparatus according to claim 28, wherein the apparatus is operated in a vacuum.

30. An image display apparatus according to claim 28, wherein said control means includes memory means, containing data relating to the number of said electron sources and intensity levels, for outputting a signal identifying an intensity level of each of said luminescent units of said picture elements.

31. An image display apparatus according to claim 30, wherein said control means further includes an A/D converter, a timing-pulse generator and an electron source driver, wherein said A/D converter receives a sampling pulse from said timing-pulse generator and outputs a digital video signal to said memory means, said timing-pulse generator inputs a timing-pulse signal to said memory means, and said memory means outputs on-off signals to said electron source driver.

32. An image display apparatus in which luminance contrast is produced by electron beams, comprising:

a phosphor display including a plurality of picture elements each having a plurality of miniature luminescent units which respectively exhibit luminescence in response to the application of one of a plurality of corresponding electron beams, said picture elements being arranged in lines and columns;

solid-state electron-beam generating means having a plurality of electron sources for generating the plurality of electron beams which respectively energize said plurality of miniature luminescent units in each of said picture elements, wherein said solid-state electron-beam generating means is impressed with a predetermined voltage such that said solid-state electron beam generating means operates substantially in its saturated region thereby producing the plurality of corresponding electron beams with minimum variation therebetween, and the fluorescent intensity of each respectively energized miniature luminescent unit of said phosphor display will be substantially the same; and control means for controlling said solid-state electron-beam generating means in accordance with a gradation signal to selectively actuate said plurality of electron sources such that the period of time available for the emission of the plurality of electron beams to be emitted to each of said corresponding picture elements is varied to regulate the fluorescent intensity of each of said picture elements.

33. An image display apparatus according to claim 32, wherein the apparatus is operated in a vacuum.

34. An image display apparatus according to claim 32, wherein said control means includes a multiple line memory, a V/T transducer, and an electron source driver, with said multiple line memory receiving a video signal and outputting a signal to said V/T transducer, which outputs a pulse-width signal to said electron source driver, which in turn outputs drive pulses to said electron beam generating means.

35. An image display apparatus in which luminance contrast is produced by electron beams, comprising:

a phosphor display including a plurality of picture elements each having a plurality of miniature luminescent units which respectively exhibit luminescence in response to the application of one of a plurality of corresponding electron beams, said picture elements being arranged in lines and columns;

solid-state electron-beam generating means having a plurality of electron sources for generating the plurality of electron beams which respectively energize said plurality of miniature luminescent units in each of said picture elements, wherein said solid-state electron-beam generating means is impressed with a predetermined voltage such that said solid-state electron beam generating means operates substantially in its saturated region thereby producing the plurality of corresponding electron beams with minimum variation therebetween, and the fluorescent intensity of each respectively energized miniature luminescent unit of said phosphor display will be substantially the same; and control means for controlling said solid-state electron-beam generating means in accordance with a gradation signal to selectively actuate said plurality of electron sources such that the number of said miniature luminescent units within each picture element that are simultaneously energized by a corresponding electron beam is varied and to selectively actuate said plurality of electron sources such that the period of time available for the emission of the plurality of electron beams to be emitted to each of said corresponding picture elements is varied to regulate the fluorescent intensity of each of said picture elements.

36. An image display apparatus according to claim 35, wherein the apparatus is operated in a vacuum.

37. An image display apparatus according to claim 35, wherein said control means includes memory means, containing data relating to the number of said electron sources and intensity levels, for outputting a signal identifying an intensity level of each of said luminescent units of said picture elements.

38. An image display apparatus according to claim 37, wherein said control means further includes an A/D converter, a timing-pulse generator and an electron source driver, wherein said A/D converter receives a sampling pulse from said timing-pulse generator and outputs a digital video signal to said memory means, said timing-pulse generator inputs a timing-pulse signal to said memory means, and said memory means outputs on-off signals to said electron source driver.

39. An image display apparatus according to claim 35, wherein said control means includes a multiple line memory, a V/T transducer, and an electron source driver, with said multiple line memory receiving a video signal and outputting a signal to said V/T transducer, which outputs a pulse-width signal to said electron source driver, which in turn outputs drive pulses to said electron beam generating means.

* * * * *

UNITED STATES PATENT AND TRADEMARK OFFICE

CERTIFICATE OF CORRECTION

PATENT NO. : 5,691,608

DATED : November 25, 1997

INVENTOR(S) : Yamamoto et al.

It is certified that error appears in the above-identified patent and that said Letters Patent is hereby corrected as shown below:

On the title page: Item

[56] Refrences Cited:

U.S. PATENT DOCUMENTS

"4,325,084 4/1982 Van Gorkum et al." should read --4,325,084 4/1982 Van Gorkom et al.--.

FOREIGN PATENT DOCUMENTS

"38528 1/1982 Japan" should read --38528 3/1983 Japan--.

[57] ABSTRACT:

Line 16, "emission" should read --emission during--.

COLUMN 1:

Line 66, "phosphers" should read --phosphors--.

UNITED STATES PATENT AND TRADEMARK OFFICE

CERTIFICATE OF CORRECTION

PATENT NO. : 5,691,608

DATED : November 25, 1997

INVENTOR(S) : Yamamoto et al.

It is certified that error appears in the above-identified patent and that said Letters Patent is hereby corrected as shown below:

COLUMN 7:

Line 1, "711" should read --71*l*--.

Signed and Sealed this

Twenty-third Day of June, 1998

Bruce Lehman

*Attest:*

BRUCE LEHMAN

*Attesting Officer*

*Commissioner of Patents and Trademarks*